US007073487B1

(12) United States Patent
Oono

(10) Patent No.: US 7,073,487 B1
(45) Date of Patent: Jul. 11, 2006

(54) FUEL PRESSURE CONTROL APPARATUS FOR MULTICYLINDER INTERNAL COMBUSTION ENGINE

(75) Inventor: Takahiko Oono, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/209,669

(22) Filed: Aug. 24, 2005

(30) Foreign Application Priority Data

Mar. 1, 2005 (JP) ..... 2005-055785

(51) Int. Cl.
*F02M 69/54* (2006.01)
*F02M 69/46* (2006.01)

(52) U.S. Cl. ..... 123/457; 123/456

(58) Field of Classification Search ..... 123/446, 123/456, 508, 457, 458, 459, 510
See application file for complete search history.

(56) References Cited

U.S. PATENT DOCUMENTS 6,868,826 B1 * 3/2005 Oono ..... 123/339.1
6,871,633 B1 * 3/2005 Date et al. ..... 123/447
6,889,666 B1 * 5/2005 Oono ..... 123/514
6,918,376 B1 * 7/2005 Oono et al. ..... 123/458

FOREIGN PATENT DOCUMENTS

JP 04-365956 B2 12/1992
JP 11-324757 A 11/1999

* cited by examiner

*Primary Examiner*—Mahmoud Gimie
(74) *Attorney, Agent, or Firm*—Sughrue Mion, PLLC

(57) ABSTRACT

A fuel pressure control apparatus for a multicylinder internal combustion engine includes fuel injection valves arranged one for each of M cylinders (M≧3), a fuel rail, a high pressure fuel pump performing N (≧2) fuel discharge strokes to the fuel rail during a fuel injection stroke makes a round of the cylinders, a fuel discharge amount control valve, an FF amount calculation section for calculating the fuel discharge amount based on the fuel injection amount, and a fuel discharge amount control section for determining the fuel discharge amount based on the FF amount and setting the drive timing of the fuel discharge amount control valve. The fuel injection amount multiplied by M/N is used as an FF amount in the fuel discharge amount three times while the fuel injection stroke makes a round of the cylinders.

4 Claims, 10 Drawing Sheets

AT THE TIME OF NON-ENERGIZATION OF SOLENOID

AT THE TIME OF ENERGIZATION OF SOLENOID

FUEL PRESSURE CONTROL APPARATUS FOR MULTICYLINDER INTERNAL COMBUSTION ENGINE

BACKGROUND OF THE INVENTION

1. Field of the Invention

The present invention is a fuel pressure control apparatus for a multicylinder internal combustion engine which is capable of injecting fuel into respective cylinders of the multicylinder internal combustion engine while controlling the pressure of fuel in a fuel rail at a high pressure. More particularly, the invention relates to such a fuel pressure control apparatus for a multicylinder internal combustion engine that is provided with a high pressure fuel pump having N (N<M) times of fuel discharge stroke with respect to the fuel rail during one round of the fuel injection stroke to M pieces of cylinders.

2. Description of the Related Art

In recent years, there has been put into practical use internal combustion engines in which the pressure of fuel in a fuel rail is controlled to a desired target high pressure value so as to inject the fuel in an atomized state (see, for example, a first patent document (Japanese patent No. 2890898) and a second patent document (Japanese patent application laid-open No. 11-324757)). Hereinafter, an example of the construction of a fuel system in such a kind of four-cylinder internal combustion engine will be described. A high pressure fuel pump for pressurizing fuel to a high pressure is provided with a plunger that reciprocates in a cylinder defining therein a pressure chamber, with a lower end of the plunger being made into pressure contact with a cam mounted on a camshaft of the internal combustion engine. With this arrangement, as the cam rotates in conjunction with the rotation of the camshaft, the plunger is caused to reciprocate in the cylinder, whereby the volume of the pressure chamber is changed.

Here, note that the plunger is reciprocated in the cylinder three times during one revolution of the camshaft, and hence in case of the four-cylinder internal combustion engine, it performs three reciprocations during the time when the fuel injection stroke to the respective cylinders of the engine makes a round (i.e., during two revolutions of the internal combustion engine). In addition, an inflow passage upstream of the pressure chamber is connected with a fuel tank through a check valve, a low pressure pump and a low pressure regulator, so that when the plunger is moved downward in the pump cylinder, the fuel discharged from the low pressure pump, after being adjusted to a predetermined low pressure by means of the low pressure regulator, is introduced into the pressure chamber through the check valve.

On the other hand, a feed passage downstream of the pressure chamber is connected with a fuel rail through a check valve, so that the fuel rail serves to hold the high pressure fuel discharged from the pressure chamber and distribute it to fuel injection valves. Here, note that the check valve in the feed passage serves to check or restrict the backflow of fuel from the fuel rail to the pressure chamber. In the four-cylinder internal combustion engine, a total of four of fuel injection valves are provided one for each engine cylinder.

In addition, a normally closed relief valve, being opened at a predetermined valve opening pressure or above, is connected with the fuel rail, and when the fuel pressure in the fuel rail is about to rise to or above the predetermined valve opening pressure value set for the relief valve, the relief valve is opened to return the fuel in the fuel rail to the fuel tank through the relief passage, thereby preventing an excessive increase in the fuel pressure.

A fuel discharge amount control valve in the form of a normally open electromagnetic valve for example is arranged between the feed passage and a spill passage, so that when the plunger of the high pressure fuel pump is caused to move upward in the pump cylinder, fuel discharged from the pressure chamber to the feed passage is returned from the spill passage to the inflow passage during the time the fuel discharge amount control valve is controlled to open, as a result of which high pressure fuel is not supplied to the fuel rail. After the fuel discharge amount control valve is closed at a predetermined timing during the upward movement of the plunger in the pump cylinder, the pressurized fuel discharged from the pressure chamber to the feed passage is supplied to the fuel rail through the check valve.

A control unit in the form of an ECU (electronic control unit) determines a target fuel pressure based on the operating condition of the internal combustion engine, and controls the drive timing of the fuel discharge amount control valve so that the fuel pressure in the fuel rail is made to coincide with the target fuel pressure. In addition, the ECU also specifies the rotational angle position of the internal combustion engine based on the rotational phase of a crankshaft and the rotational phase of a camshaft, and calculates the amount of fuel per cylinder to be injected to each engine cylinder based on the amount of depression of an accelerator pedal, whereby the fuel injection valves are driven to operate under the control of the ECU.

Next, reference will be made to the operation of controlling the amount of fuel to be discharged. In the fuel suction stroke in which the plunger of the high pressure fuel pump is caused to move downward from the upper end up to the lower end of the pump cylinder, low pressure fuel is sucked from the suction passage into the pressure chamber through the check valve. On the other hand, when a solenoid in the fuel discharge amount control valve is not energized in the fuel discharge stroke in which the plunger is caused to move upward from the lower end up to the upper end of the pump cylinder, the fuel discharge amount control valve is opened so that the fuel discharged from the high pressure fuel pump to the feed passage is returned to the inflow passage through the spill passage, as a result of which fuel is not fed to the fuel rail.

Moreover, when the solenoid in the fuel discharge amount control valve is constantly energized in the fuel discharge stroke, the fuel discharge amount control valve is closed whereby an amount of fuel corresponding to a maximum fuel discharge amount discharged from the high pressure fuel pump to the feed passage is fed to the fuel rail through the check valve. Also, when the solenoid is energized at a certain time during the fuel discharge stroke, the fuel discharge amount control valve is closed after the time point of the energization of the solenoid, so only the fuel discharged from the high pressure fuel pump to the feed passage during the upward movement of the plunger is fed to the fuel rail through the check valve.

As described above, by energizing the solenoid at a predetermined timing in the fuel discharge stroke, the amount of fuel to be discharged is adjusted to a desired amount within the range from zero to the maximum fuel discharge amount. Here, note that the energization start timing of the solenoid is uniquely determined from the amount of fuel to be discharged by storing a correlation characteristic between the energization start timing of the solenoid and the amount of fuel to be discharged in the ECU. In addition, in order to maintain the fuel pressure in the fuel rail at the present value, the flow rate of fuel injected by the fuel injection valve (fuel flowing out from the fuel rail) and the flow rate of fuel discharged by the high pressure fuel pump (fuel flowing into the fuel rail) need only to be controlled so that they become equal with each other.

Accordingly, in the above-mentioned first patent document or second patent document, a fuel discharge amount (an amount of fuel to be discharged) is determined by adding a fuel injection amount per cylinder injected from the fuel injection valve (feedforward amount: FF amount) to an amount of fuel to be discharged (feedback amount: FB amount) that is obtained based on a pressure deviation between a target fuel pressure set in accordance with the operating condition of the internal combustion engine and a fuel pressure detected by a fuel pressure sensor.

Here, the fuel injection amount is an amount that can be grasped by the ECU as a known amount of fuel flowing out from the fuel rail, so it is set as the FF amount to supplement the amount of outflow fuel. Also, the FB amount is a feedback correction amount that is calculated under proportional-plus-integral control or the like when a pressure deviation is resulted from accuracy variation or degradation of component parts or elements in the fuel feed system without regard to the FF amount being fed to the fuel rail.

However, the maximum fuel discharge amount in one discharge stroke of the high pressure fuel pump varies depending upon how many times fuel can be discharged to the fuel rail while a fuel injection stroke makes a round through the respective cylinders, i.e., during the time the internal combustion engine makes two revolutions (=720 degrees in crank angle (deg CA)). That is, the calculation timing of the fuel injection amount in the four-cylinder internal combustion engine includes a timing at which the fuel injection valve is actually driven, a first calculation timing to execute or actuate a fuel injection amount calculation section and a fuel injection valve control setting section, and a second calculation timing to execute or actuate an FF amount calculation section, an FB amount calculation section, and a fuel discharge amount control section. The relation between the fuel discharge stroke in which fuel is actually discharged and the fuel discharge amount (the amount of fuel to be discharged) becomes as follows.

For instance, in the case where the number of crests of the cam in the high pressure fuel pump is "2", regarding the first calculation timing, four such timings are set at intervals of 180 deg CA within the range of 720 deg CA in which the fuel injection stroke to the respective cylinders makes a round. The amounts of fuel to be injected into the individual cylinders are respectively calculated, and predetermined injection timings and predetermined fuel injection pulse widths are respectively set.

On the other hand, regarding the second calculation timing, two such timings are set at intervals of 360 deg CA within the range of 720 deg CA in which the fuel injection stroke to the respective cylinders makes a round. In one of the second calculation timings, a total of the amounts of fuel to be injected for two cylinders is calculated as an FF amount and discharged in one discharge stroke. Also, in the other second calculation timing, a total of the amounts of fuel to be injected for the two remaining cylinders is calculated as an FF amount and discharged in another discharge stroke. As a result, the incoming and outgoing fuel balance of the fuel rail becomes zero as a whole and is thus maintained at the constant fuel pressure.

Thus, in case of the number of cam crests=2, the fuel discharge cycle is the same period (2 discharges for every two revolutions of the four-cylinder internal combustion engine) as the number of revolutions per minute of the engine, so the discharge cycle can be performed at a relatively low speed, and it is the most advantageous in terms of wear resistance in the sliding surfaces between the plunger and the cylinder of the high pressure fuel pump and in the contact surfaces between the cam and the plunger. However, a maximum fuel injection amount substantially at least twice as much as the maximum fuel discharge amount is needed, so there is a problem that the volume of the pressure chamber is enlarged, and the maximum fuel discharge amount, being substantially large, increases stress on the contact surfaces between the cam and the plunger thereby to deteriorate durability.

Next, explaining the case of the number of cam crests=3, regarding of the first calculation timing, the amounts of fuel to be injected into the respective cylinders are calculated at four first calculation timings, respectively, and predetermined injection timings and predetermined fuel injection pulse widths are set, as in the case of the number of cam crests=2.

On the other hand, regarding the second calculation timing, three such timings are set at intervals of 240 deg CA within the range of 720 deg CA in which the fuel injection stroke to the respective cylinders makes a round. In a first one of the second calculation timings, a total of the amounts of fuel to be injected for two cylinders is calculated as an FP amount and discharged in the discharge stroke. Also, in a second one of the second calculation timings, the amount of fuel to be injected for one of the two remaining cylinders is calculated as an FF amount, and the FF amount equal to the fuel injection amount is discharged in the discharge stroke. Further, in a third one of the second calculation timings, too, the amount of fuel to be injected for the other one of the two remaining cylinders is calculated as an FF amount, and the FF amount equal to the fuel injection amount is discharged in the discharge stroke. As a result, the incoming and outgoing fuel balance of the fuel rail becomes zero as a whole and is thus maintained at the constant fuel pressure.

Thus, in case of the number of cam crests=3, the fuel discharge cycle is a period 1.5 times as large as the number of revolutions per minute of the engine (3 discharges for every two revolutions of the four-cylinder internal combustion engine). Therefore, the discharge period becomes higher speed (i.e., shorter) than at the time of the number of cam crests=2, thus resulting in a disadvantage in terms of wear resistance in the sliding surfaces between the plunger and the pump cylinder and in the contact surfaces between the plunger and the cam, as compared with the case of the number of cam crests=2. Besides, since the maximum fuel discharge amount corresponding to twice the maximum fuel injection amount is needed, as in the case of the number of cam crests=2, there still remains the problem that the volume of the pressure chamber is enlarged, and stress on the contact surfaces between the cam and the plunger is increased to deteriorate durability.

Next, explaining the case of the number of cam crests=4, regarding the first calculation timing, the description is the same as that in the cases of the number of cam crests=2 and the number of cam crests=3. On the other hand, regarding the second calculation timing, four such timings are set at intervals of 180 deg CA within the range of 720 deg CA in which the fuel injection stroke to the respective cylinders makes a round, and the amount of fuel to be injected for one cylinder is calculated at each calculation timing as an FF amount, and the FF amount equal to the fuel injection amount is discharged in each discharge stroke. As a result, the incoming and outgoing fuel balance of the fuel rail becomes zero as a whole and is thus maintained at the constant fuel pressure.

As described above, in case of the number of cam crests=4, the maximum fuel discharge amount can be made equal to the maximum fuel injection amount, so the volume of the pressure chamber can be reduced to a minimum, and the actual maximum fuel discharge amount can also be small, as a result of which stress on the contact surfaces between the plunger and the cam is reduced, and it is the most advantageous in terms of durability. However, since the fuel discharge cycle is a period equal to twice the number of revolutions per minute of the engine (i.e., four discharges for every two revolutions of the four-cylinder internal combustion engine), the discharge cycle becomes the highest speed, thus causing a problem that wear resistance in the sliding surfaces between the plunger and the pump cylinder and in the contact surfaces between the plunger and the cam is deteriorated.

Thus, in order to improve the reliability of the high pressure fuel pump, it is desirable to increase the fuel discharge period and reduce the maximum fuel discharge amount, but there arises a problem that in case where such a scheme is intended to be applied to a high power internal combustion engine, it becomes difficult to provide durability and wear resistance of the high pressure fuel pump, thereby making it impossible to ensure reliability.

That is, when comparing the characteristic of the high pressure fuel pump with respect to the number of cam crests, in the relation between the discharge cycle and the maximum fuel discharge amount of the high pressure fuel pump, it is desired that the discharge cycle be set to be at as low speed as possible and the maximum fuel discharge amount be set to be as small as possible. However, it is difficult to improve reliability more than the present state without any great increase in cost. In particular, there is a problem that in case of high power four-cylinder internal combustion engines in which the maximum fuel injection amount is further increased, it is impossible to make durability and wear resistance of the high pressure fuel pump compatible with each other.

Here, it is considered, for instance, that by installing two high pressure fuel pumps with two cam crests and driving them in parallel, the discharge period is made to be at low speed and at the same time the volume of the pressure chamber is reduced, thereby making durability and wear resistance compatible with each other. In this case, however, a large increase in cost will be induced, and it can not be said a practical method of solution at all even from the viewpoint of installation. In the known fuel pressure control apparatuses for a multicylinder internal combustion engine, in case of the number of cam crests of the high pressure fuel pumps being equal to 2, the maximum fuel discharge amount corresponding to twice the maximum fuel injection amount is required and hence there has been the problem that the volume of the pressure chamber is enlarged, and the maximum fuel discharge amount, being substantially large, increases stress on the contact surfaces between the cam and the plunger thereby to deteriorate durability. In addition, in case of the number of cam crests=3 or 4, the discharge period becomes high speed (i.e., short), resulting in a disadvantage in terms of wear resistance on the sliding surfaces between the plunger and the pump cylinder and on the contact surfaces between the plunger and the cam. Besides, there is also the problem that the volume of the pressure chamber is enlarged, and stress on the contact surfaces between the cam and the plunger is increased to deteriorate durability, as in the case of the number of cam crests=2.

SUMMARY OF THE INVENTION

The object of the present invention is to obtain a fuel pressure control apparatus for a multicylinder internal combustion engine which is capable of improving the reliability of a high pressure fuel pump by reducing a maximum fuel discharge amount without a large increase in cost while adopting the high pressure fuel pump with the number of cam crests=3 whose discharge cycle is at a speed lower than in the case of the number of cam crests=4.

Bearing the above object in mind, according to the present invention, there is provided a fuel pressure control apparatus for a multicylinder internal combustion engine in which fuel is injected into the internal combustion engine having M cylinders, the apparatus includes: fuel injection valves arranged one for each of the cylinders; a fuel injection amount calculation section that calculates a fuel injection amount per cylinder to be injected into each of the cylinders; a fuel injection valve control section that determines the injection pulse width of each of the fuel injection valves based on the fuel injection amount thereby to set the drive timing for each of the fuel injection valves; a fuel rail that is connected in common with the fuel injection valves to store high pressure fuel; a high pressure fuel pump that has N fuel discharge strokes with respect to the fuel rail while a fuel injection stroke makes a round of the respective cylinders; a fuel discharge amount control valve that adjusts a fuel discharge amount from the high pressure fuel pump; an FF amount calculation section that calculates, as an FF amount, a feedforward amount in the fuel discharge amount of the high pressure fuel pump based on the fuel injection amount; and a fuel discharge amount control section that determines the fuel discharge amount of the high pressure fuel pump based on the FF amount and sets the drive timing of the fuel discharge amount control valve. The FF amount calculation section uses the fuel injection amount multiplied by M/N as an FF amount in the fuel discharge amount of the high pressure fuel pump in three times while the fuel injection stroke makes a round of the respective cylinders.

In addition, in case where the maximum fuel discharge amount is not reduced but set to the same amount as that in a conventional apparatus, the present invention can be applied to a high power internal combustion engine particularly with a large maximum fuel injection amount without deteriorating durability.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described in detail while referring to the accompanying drawings.

Embodiment 1

Figure 1:
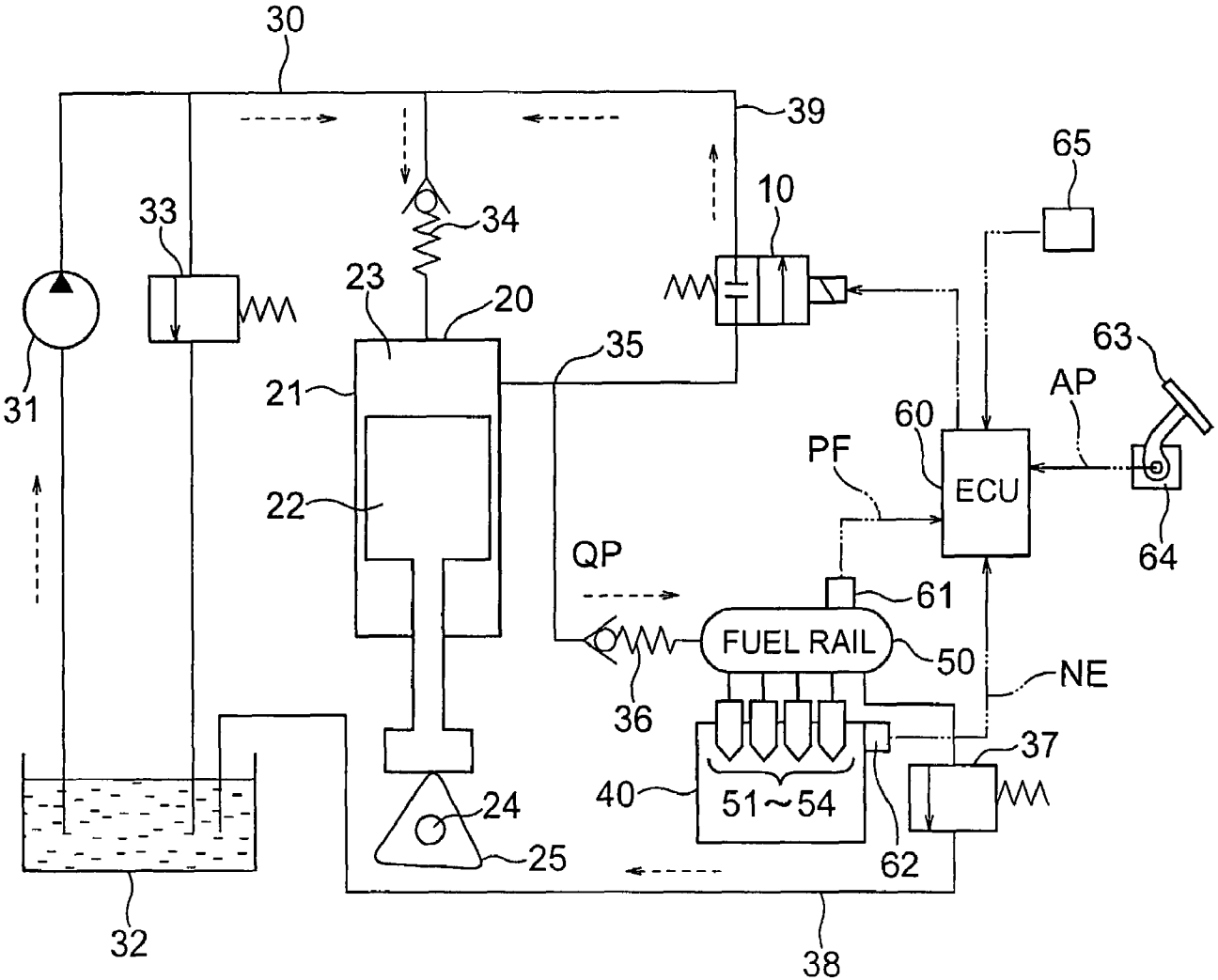
FIG. 1 is a block diagram showing a fuel pressure control apparatus for a multicylinder internal combustion engine according to a first embodiment of the present invention.

Hereinafter, reference will first be made to a fuel pressure control apparatus for a multicylinder internal combustion engine according to a first embodiment of the present invention while referring to the accompanying drawings. FIG. 1 is a block diagram that illustrates the fuel pressure control apparatus for a multicylinder internal combustion engine according to the first embodiment of the present invention.

Here, reference will be made to the fuel pressure control apparatus for a multicylinder internal combustion engine with the number of cylinders being M (M being a natural number not less than 2, and in particular M being set to 4 in this example) while using a high pressure fuel pump which has N fuel discharge strokes (in general, N being a natural number not less than 1, N<M, and the value of M/N being not any natural number; in particular N being set to 3 in this example) during the time the fuel injection stroke to the respective cylinders makes a round. In FIG. 1, a high pressure fuel pump 20 for pressurizing fuel to a high pressure is provided with a cylinder 21, a plunger 22 that is received to reciprocate in the cylinder 21, and a pressure chamber 23 that is defined by an inner peripheral wall surface of the cylinder 21 and an upper end face of the plunger 22.

The plunger 22 has its lower end placed in pressure contact with a cam 25 mounted on a camshaft 24 of an internal combustion engine 40, so that the cam 25 is caused to rotate in conjunction with the rotation of the camshaft 24, whereby the plunger 22 is driven to reciprocate in the cylinder 21, thereby changing the volume of the pressure chamber 23. In FIG. 1, the cam 25 has three protrusions or crests so that the plunger 22 is caused to reciprocate in the cylinder 21 three times during one revolution of the camshaft 24. Accordingly, the plunger 22 reciprocates three times while the fuel injection stroke to the respective cylinders of the internal combustion engine 40 makes a round, i.e., while the internal combustion engine 40 makes two revolutions.

In addition, an inflow passage 30 connected with an upstream side of the pressure chamber 23 is connected with a fuel tank 32 through a low pressure pump 31. The low pressure pump 31 serves to suck fuel in the fuel tank 32 and discharge it. The fuel discharged from the low pressure pump 31, after being adjusted to a predetermined low pressure by means of a low pressure regulator 33, is introduced into the pressure chamber 23 through a check valve 34 when the plunger 22 is moved downward in the pump cylinder 21.

On the other hand, a feed passage 35 connected with a downstream side of the pressure chamber 23 is connected with a fuel rail 50 through a check valve 36. The check valve 36 serves to check or restrict the backflow of fuel from the fuel rail 50 to the pressure chamber 23. The fuel rail 50 accumulates and holds the high pressure fuel discharged from the pressure chamber 23, and it is connected in common to individual fuel injection valves 51 through 54 for distributing the high pressure fuel to the fuel injection valves 51 through 54, respectively. Here, a total of four of fuel injection valves are provided one for each engine cylinder.

Moreover, a relief valve 37 connected with the fuel rail 50 is in the form of a normally closed valve that is opened upon application of a predetermined valve-opening pressure. When the fuel pressure PF of the fuel in the fuel rail 50 is about to rise more than the set value of the valve-opening pressure of the relief valve 37. As a result, the fuel in the fuel rail 50, being about to rise more than the valve-opening pressure set value, is returned to the fuel tank 32 through a relief passage 38, so that the fuel pressure PF in the fuel rail 50 does not become excessively large.

A fuel discharge amount control valve 10 is in the form of a normally open electromagnetic valve for instance, and is arranged between the feed passage 35 and a spill passage 39 in such a manner that it is driven to open and close under the control of an ECU 60 so as to control the amount of fuel QP to be discharged from the high pressure fuel pump 20 to the fuel rail 50. When the plunger 22 is caused to move upward in the cylinder 21 in the high pressure fuel pump 20, the fuel discharged from the pressure chamber 23 into the feed passage 35 is returned to the inflow passage 30 through the spill passage 39 (see a broken line arrow) during the time the fuel discharge amount control valve 10 is controlled to open.

Accordingly, the high pressure fuel is not supplied to the fuel rail 50 when the fuel discharge amount control valve 10 is under the valve opening control. On the other hand, after the fuel discharge amount control valve 10 is closed at a predetermined timing during the upward movement of the plunger 22 in the pump cylinder 21, the pressurized fuel discharged from the pressure chamber 23 to the feed passage 35 is supplied to the fuel rail 50 through the check valve 36.

In addition to the fuel pressure PF detected by a fuel pressure sensor 61, operating condition information from various kinds of sensors such as a crank angle sensor 62, an accelerator position sensor 64, a cam angle sensor 65, etc., is input to the ECU 60. The fuel pressure sensor 61 detects the fuel pressure PF in the fuel rail 50, and the crank angle sensor 62 detects the rotational speed of the crankshaft of the internal combustion engine 40 (the number of revolutions per minute of the engine NE) and the rotational phase thereof. The accelerator position sensor 64 detects the amount of depression AP of an accelerator pedal 63, and the cam angle sensor 65 detects the rotational phase of the camshaft 24 of the internal combustion engine 40.

The ECU 60 determines a target fuel pressure PO based on the detection information from the various kinds of sensors, and controls the drive timing of the fuel discharge amount control valve 10 so as to make the fuel pressure PF in the fuel rail 50 coincide with the target fuel pressure PO. Also, the ECU 60 specifies the rotational angle position of the internal combustion engine 40 based on the rotational phase of the crankshaft detected by the crank angle sensor 62 and the rotational phase of the camshaft 24 detected by the cam angle sensor 65, and calculates, based on the amount of depression AP of the accelerator pedal 63 detected by the accelerator position sensor 64, the amount of fuel to be injected to each engine cylinder, and controls to drive the fuel injection valve 51 through 54, respectively.

Figure 2A:
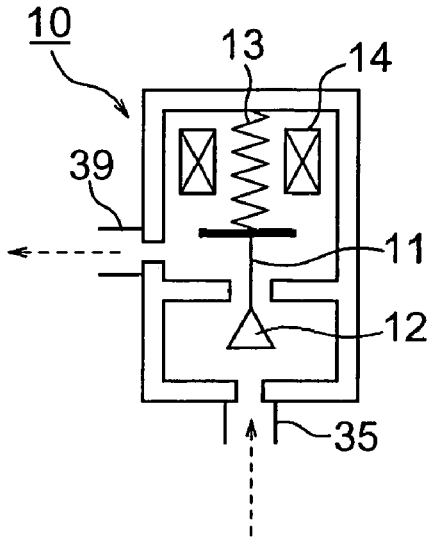
FIGS. 2A and 2B are cross sectional side views showing the internal construction of a fuel discharge amount control valve in FIG. 1 at different operating states thereof.

Now, reference will be made to the specific internal construction of the fuel discharge amount control valve 10 in FIG. 1 while referring to cross sectional side views of FIGS. 2A and 2B. FIG. 2A illustrates the state in which the solenoid 14 is non-energized, and FIG. 2B illustrates the state in which a solenoid 14 is energized (driven to excite).

The fuel discharge amount control valve 10 includes a spill valve plunger 11, a spill valve 12 operatively connected with the spill valve plunger 11, a compression spring 13 for urging the spill valve plunger 11 in a direction to release the spill valve 12, and the solenoid 14 for driving the spill valve plunger 11 in a direction to close the spill valve 12. The spill valve 12 is connected with one end of the spill valve plunger 11 which is in turn connected at its other end with the compression spring 13. With this arrangement, the spill valve plunger 11 serves to open and close between the feed passage 35 and the spill passage 39 in accordance with the non-energized state/energized state of the solenoid 14.

When the solenoid 14 is not energized, as shown in FIG. 2A, the spill valve 12 is depressed downwardly by the urging force of the compression spring 13 to place the feed passage 35 and the spill passage 39 in fluid communication with each other. At this time, the fuel discharge amount control valve 10 is put into a valve-opening state, so the fuel discharged to the feed passage 35 flows toward the spill passage 39 (see a broken line arrow).

Figure 2B:
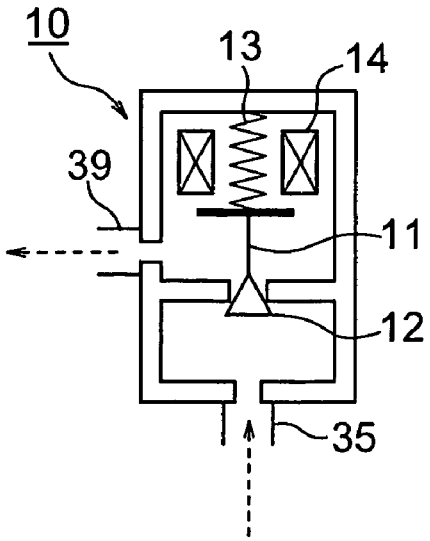

On the other hand, when the solenoid 14 is energized by the ECU 60, as shown in FIG. 2B, the electromagnetic force generated by the solenoid 14 overcomes the urging force of the compression spring 13 to electromagnetically attract the spill plunger 11 in the upward direction. As a result, the spill valve 12 is lifted upwardly to interrupt between the feed passage 35 and the spill passage 39. At this time, the fuel discharge amount control valve 10 is put into a valve-closing state.

Figure 3:
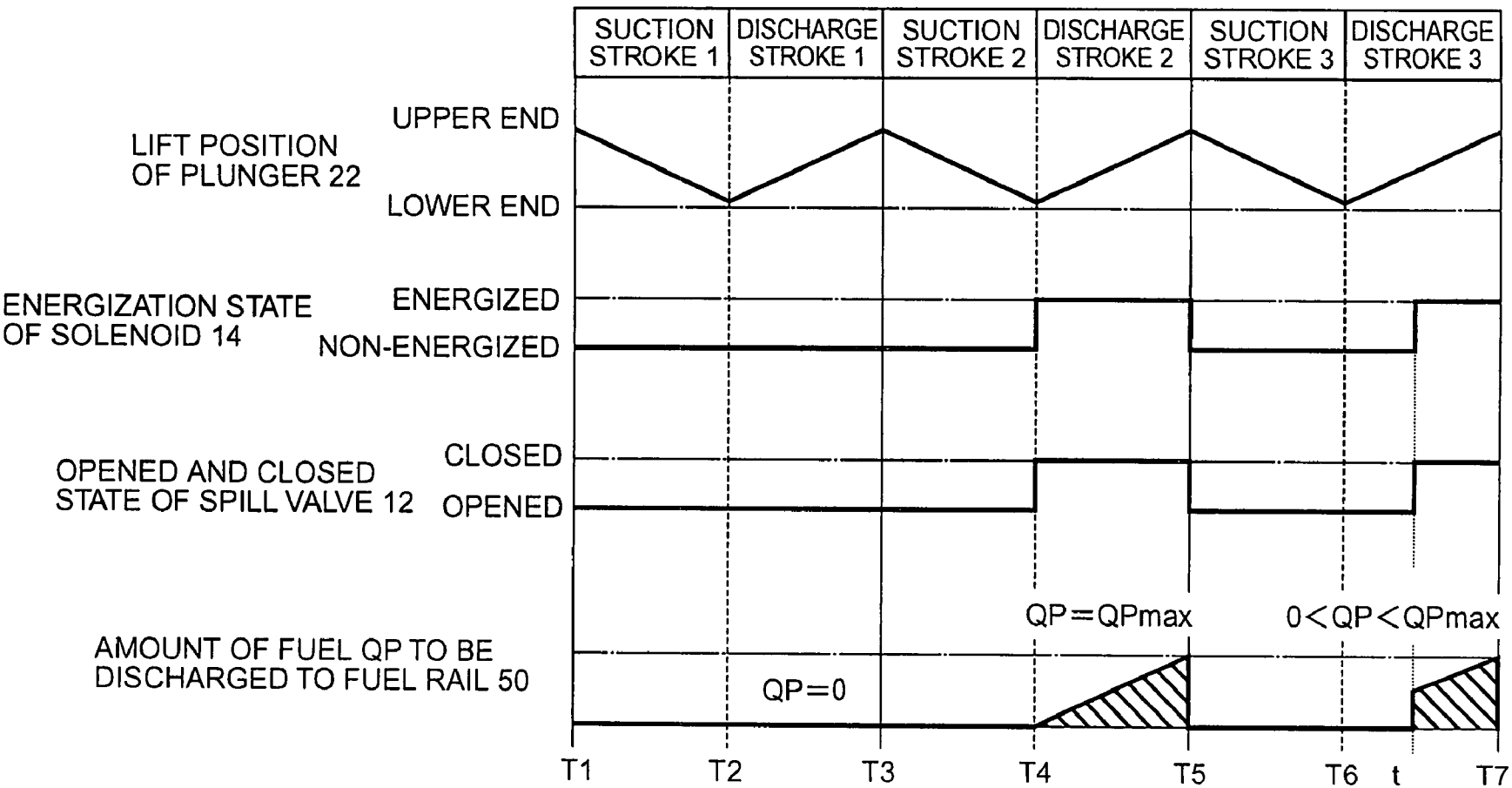
FIG. 3 is a timing chart illustrating a general method for controlling the amount of fuel to be discharged according to the apparatus shown in FIG. 1.
Figure 4:
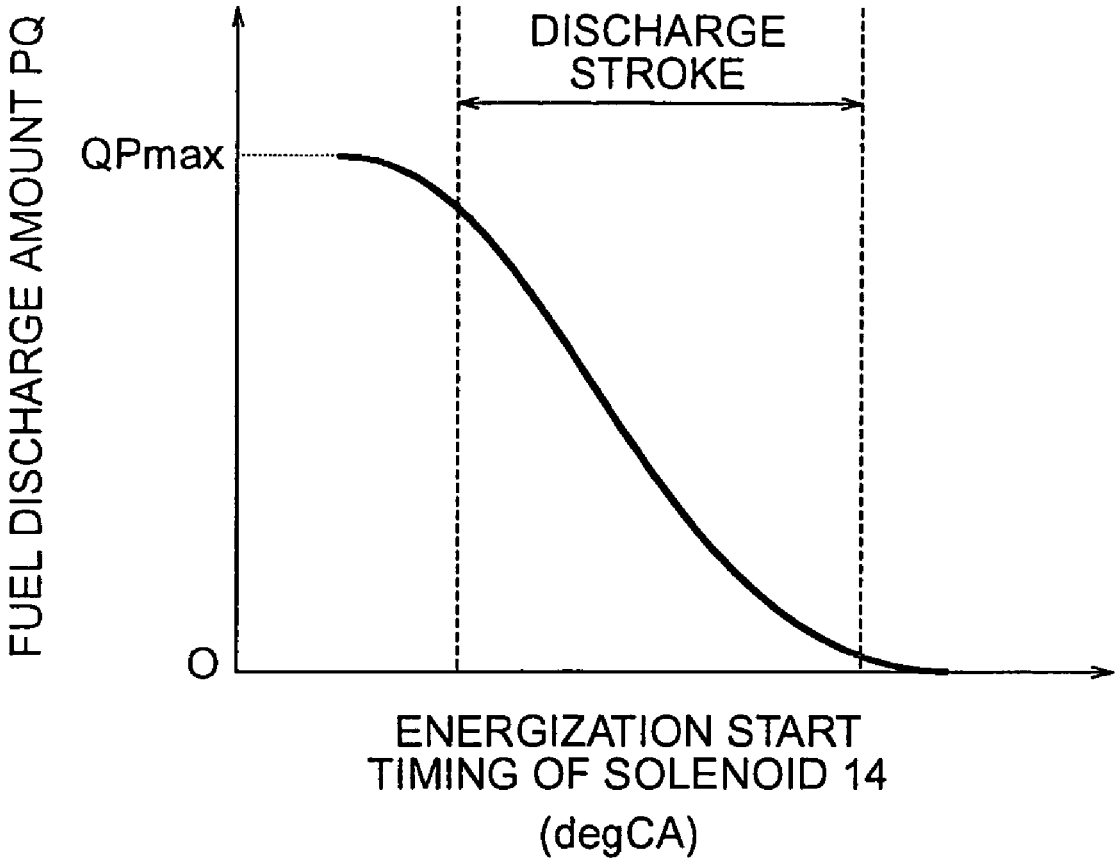
FIG. 4 is a characteristic view illustrating the relation between the solenoid energization start timing of the fuel discharge amount control valve shown in FIGS. 2A and 2B and the amount of fuel to be discharged by the high pressure fuel pump in FIG. 1.

Next, reference will be made to the general construction and the control operation of the fuel pressure control apparatus for a multicylinder internal combustion engine with reference to FIGS. 1 through 5 while taking as an example the case where the first embodiment of the present invention is not applied. First of all, the control operation of the fuel control apparatus for controlling the amount of fuel QP to be discharged, as shown in FIG. 1, will be described while referring to a timing chart of FIG. 3 together with FIGS. 2A and 2B. In FIG. 3, the lift position (from the upper end to the lower end) of the plunger 22 which repeats vertical motion in conjunction with the rotation of the cam 25, the state of energization (energization or non-energization) of the solenoid 14 in the fuel discharge amount control valve 10, and the opened or closed state of the spill valve 12, and the fuel discharge amount QP fed to the fuel rail 50 are shown in this order.

In FIG. 3, the duration between time points T1, T2, the duration between time points T3, T4, and the duration between time points T5, T6 represent individual fuel suction strokes 1, 2 and 3, respectively, in which the plunger 22 is caused to move downward from an upper end up to a lower end. In the fuel suction strokes 1, 2 and 3, low pressure fuel is sucked into the pressure chamber of the high pressure fuel pump 20 from the suction passage 30 through the check valve 34.

The duration between time points T2, T3, the duration between time points T4, T5, and the duration between time points T6, T7 represent individual fuel discharge strokes 1, 2 and 3, respectively, in which the plunger 22 is caused to move upward from the lower end up to the upper end. In the fuel discharge strokes 1, 2 and 3, when the solenoid 14 is not energized as in the fuel discharge stroke 1 (between time points T2, T3), the fuel discharge amount control valve 10 is opened, as shown in FIG. 2A. At this time, the fuel discharged from the high pressure fuel pump 20 to the feed passage 35 is returned to the inflow passage 30 through the spill passage 39, and hence is not supplied to the fuel rail 50, as a result of which the fuel discharge amount QP becomes zero (QP=0).

On the other hand, when the solenoid 14 is energized at all times, as in the fuel discharge stroke 2 (between time points T4, T5), the fuel discharge amount control valve 10 is closed, as shown in FIG. 2B. At this time, the fuel discharged from the high pressure fuel pump 20 to the feed passage 35 is supplied to the fuel rail 50 through the check valve 36. In addition, the fuel discharge amount QP at this time corresponds to a maximum fuel discharge amount QPmax, and hence QP=QPmax.

In addition, when the solenoid 14 is energized from time point t (T6<t<T7) in a stroke, as in the fuel discharge stroke 3 (between time points T6 and T7), the fuel discharge amount control valve 10 is closed after time point t. Accordingly, during the upward movement of the plunger 22 between time points t and T7, only the fuel discharged from the high pressure fuel pump 20 to the feed passage 35 is supplied to the fuel rail 50 through the check valve 36. The fuel discharge amount QP at this time becomes a range of less than the maximum fuel discharge amount QPmax, and hence 0<QP<QPmax.

As can be seen from the above explanation, by energizing the solenoid 14 at a predetermined timing in the fuel discharge stroke, the fuel discharge amount QP is adjusted to a desired amount within the range from zero to the maximum fuel discharge amount (i.e., $0 \leqq QP \leqq QPmax$). Here, note that there is a relation between the energization start timing of the solenoid 14 and the fuel discharge amount QP, as represented by a characteristic view of FIG. 4, so the more the energization start timing of the solenoid 14 is retarded, the smaller does the fuel discharge amount QP become. Accordingly, by storing the characteristic of FIG. 4 in the ECU 60 beforehand, the energization start timing of the solenoid 14 (the axis of abscissa) can be determined from the fuel discharge amount QP (the axis of ordinate).

Further, in order to maintain the fuel pressure in the fuel rail 50 at the present value, the flow rate of fuel injected by the fuel injection valves 51 through 54 (=the flow rate of fuel flowing out from the fuel rail 50) and the flow rate of fuel discharged by the high pressure fuel pump 20 (=the flow rate of fuel flowing into the fuel rail 50) need only to be controlled so that they become equal with each other. Accordingly, it can be considered that an amount obtained by adding the fuel injection amount (=FF amount) per cylinder injected from each of the fuel injection valves 51 through 54 and the fuel discharge amount (=FB amount) of the high pressure fuel pump 20 to each other is determined as the amount of fuel QP to be discharged to the fuel rail 50. At this time, the fuel discharge amount (=FB amount) is obtained based on a pressure deviation between the target fuel pressure PO set in accordance with the operating condition of the internal combustion engine 40 and the fuel pressure PF detected by the fuel pressure sensor 61.

The fuel injection amount is an amount that can be grasped by the ECU itself as a known amount of fuel flowing out from the fuel rail 50, and hence it is set as an FF amount to supplement the amount of outflow fuel. Also, the fuel discharge amount (=FB amount) of the high pressure fuel pump 20 is a feedback correction amount that is calculated under proportional-plus-integral control or the like when a pressure deviation is resulted from accuracy variation or degradation of component parts or elements in the fuel feed system without regard to the FF amount being fed to the fuel rail 50.

However, the maximum fuel discharge amount QPmax in one discharge stroke of the high-pressure fuel pump 20 varies depending upon how many times fuel can be discharged to the fuel rail 50 while fuel injection stroke takes a round through the respective cylinders, i.e., during the time the internal combustion engine makes two revolutions (=720 deg CA). For instance, FIG. 5 is a timing chart illustrating the general basic control operation of the apparatus while the internal combustion engine 40 makes two revolutions (=an angular range of 720 deg CA).

Figure 5:
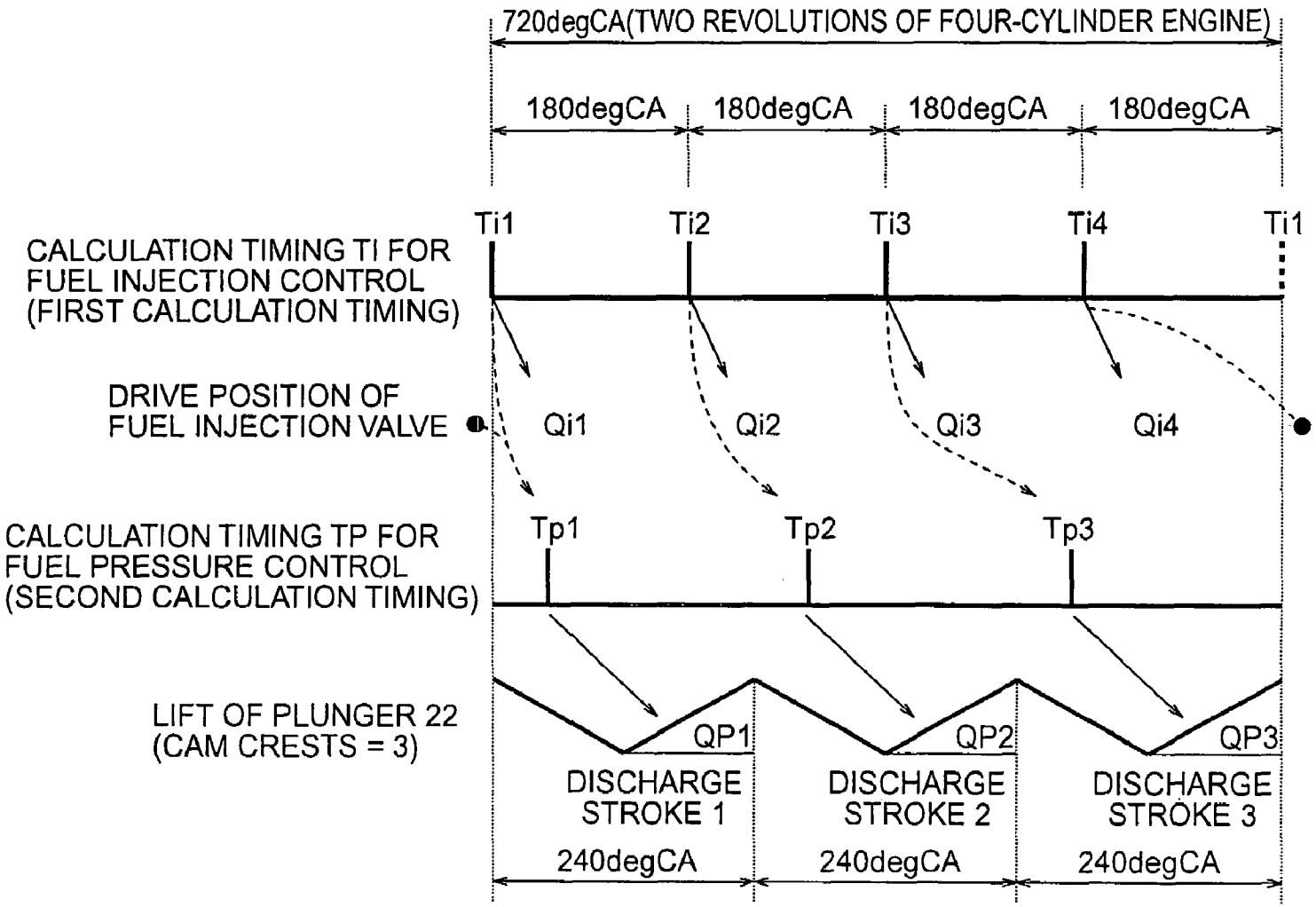
FIG. 5 is a timing chart illustrating the relation between a general fuel discharge stroke of the high pressure fuel pump with three cam crests shown in FIG. 1 and the amount of fuel to be discharged thereby.

In FIG. 5, there is shown a relation among timings Ti for calculating fuel injection amounts Qi, respectively, in the four-cylinder internal combustion engine in case of the number of cam crests being "3", timings at which the fuel injection valves 51 through 54 are actually driven, first calculation timings Ti for executing or actuating a fuel injection amount calculation section and a fuel injection valve control setting section, second calculation timings Tp for executing or actuating an FF amount calculation section, an FB amount calculation section and a fuel discharge amount control section, and fuel discharge strokes in which fuel is actually discharged and fuel discharge amounts QP1 through QP3.

In FIG. 5, first of all, four fuel injection control timings (the first calculation timings) Ti1, Ti2, Ti3 and Ti4 are set, and the fuel injection amounts Qi1, Qi2, Qi3 and Qi4 to be injected into the respective cylinders are calculated at the first calculation timings Ti1, Ti2, Ti3 and Ti4, respectively. In addition, predetermined injection timings and fuel injection pulse widths are set in the same manner as described above.

On the other hand, three fuel pressure control timings Tp1, Tp2 and Tp3 (the second calculation timings) are set at intervals of 240 deg CA within a range of 720 deg CA in which fuel injection strokes to the respective cylinders make a round. Among these, a total amount (Qi4+Qi1) of the fuel injection amounts Qi4, Qi1 for two cylinders (#4, #1) is calculated at the first second calculation timing Tp1 as an FF amount, and is discharged in a first discharge stroke 1 as an FF amount QP1 (=Qi4+Qi1: twice the fuel injection amount).

Moreover, the fuel injection amount Qi2 for one cylinder (#2) of the remaining two cylinders is calculated as an FF amount at the following second calculation timing Tp2, and is discharged in a second discharge stroke 2 as an FF amount QP2 (=Qi2: equal to the fuel injection amount). Similarly, the fuel injection amount Qi3 for the other cylinder (#3) of the remaining two cylinders is calculated as an FF amount at the final second calculation timing Tp3, and is discharged in a third discharge stroke 3 as an FF amount QP3 (=Qi3: equal to the fuel injection amount). As a result, the incoming and outgoing fuel balance of the fuel rail 50 becomes zero as a whole, and hence the present fuel pressure PF is maintained.

Thus, in case of the number of cam crests=3, if the situation is left unchanged, the fuel discharge cycle is a period 1.5 times as large as the number of revolutions per minute of the engine (3 discharges for every two rotations of the engine), as stated above, so the discharge period becomes higher speed (i.e., shorter) in comparison with the case of the number of cam crests=2, resulting in a disadvantage in terms of wear resistance on the sliding surfaces between the plunger 22 and the pump cylinder 21 and on the contact surfaces between the plunger 22 and the cam 25. In addition, since the maximum fuel discharge amount QPmax twice as large as the maximum fuel injection amount Qimax is required, the pressure chamber 23 has to be enlarged, and durability is deteriorated due to increased stress in the contact surfaces between the plunger 22 and the cam 25, too.

Accordingly, to avoid the above-mentioned problem, the FF amount calculation section (to be described later) in the ECU 60 uses the fuel injection amount multiplied by M/N (N<M) as an FF amount in the fuel discharge amount of the high pressure fuel pump 20 in N times while the fuel injection stroke to the respective cylinders (the number of the cylinders being M) makes a round. Thus, it is possible to improve reliability in the relation between the discharge cycle and the maximum fuel discharge amount QPmax of the high pressure fuel pump 20 without a large increase in cost by setting the discharge cycle to a lower speed and the maximum fuel discharge amount QPmax to a smaller value.

Figure 6:
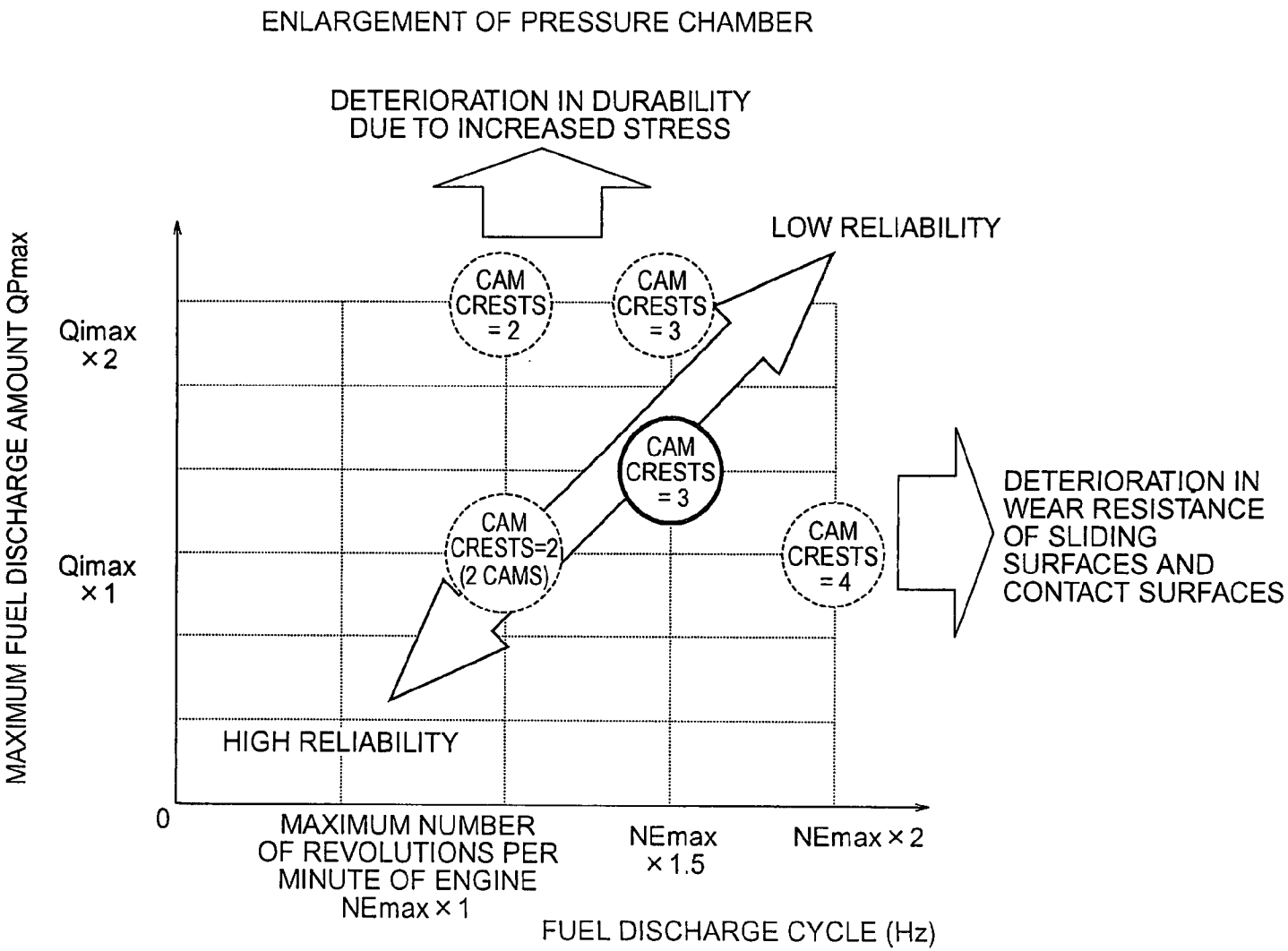
FIG. 6 is an explanatory view for comparison between the characteristic of the high pressure fuel pump in FIG. 1 and that of another one with the number of cam crests being different from that of FIG. 1.

Here, the result of comparisons between the characteristics of the high pressure fuel pump 20 with respect to the number of cam crests is organized as shown in FIG. 6. In FIG. 6, a broken line circle indicates the characteristic according to a conventional apparatus, and a solid line circle indicates the characteristic according to the first embodiment of the present invention.

In addition, in FIG. 6, as the number of cam crests increases to make the fuel discharge cycle (Hz) higher, wear resistance on the sliding surfaces or the contact surfaces deteriorates, whereas as the maximum fuel discharge amount QPmax increases, the pressure chamber 23 has to be enlarged and durability is deteriorated due to stress increase. In other words, it is found that reliability in fuel pressure control is reduced in either cases. Further, in case where two high pressure fuel pumps are driven to operate in parallel with the number of cam crests=2, as previously stated, reliability can be improved, but a large increase in cost will be invited.

Figure 7:
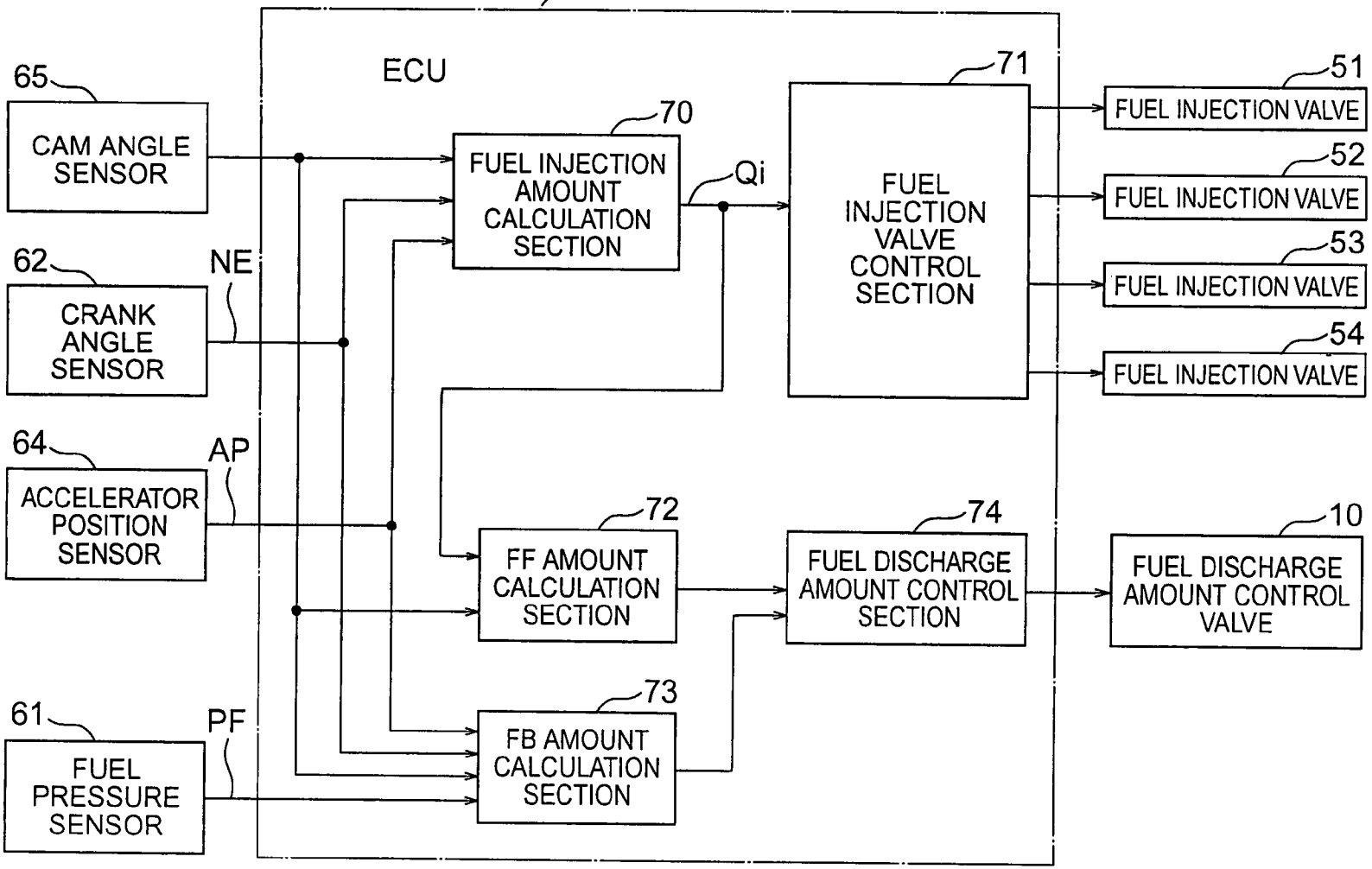
FIG. 7 is a functional block diagram showing the construction of an ECU in the fuel pressure control apparatus for a multicylinder internal combustion engine according to the first embodiment of the present invention.

Next, reference will be made to the specific internal construction of the ECU 60 in FIG. 1 while referring to FIG. 7. FIG. 7 is a block diagram that shows the specific or concrete construction of the ECU 60 according to this first embodiment of the present invention, in which the same or corresponding parts or elements as those as described above (see FIG. 1) are identified by the same symbols while omitting a detailed explanation thereof. In FIG. 7, the ECU 60 includes a fuel injection amount calculation section 70, a fuel injection valve control section 71, an FF amount calculation section 72, an FB amount calculation section 73, and a fuel discharge amount control section 74.

The fuel injection amount calculation section 70 specifies the rotational angle position of the internal combustion engine 40 based on the relation between the rotational phase of the camshaft 24 obtained from the output signal (pulse signal) of the cam angle sensor 65 and the rotational phase of the crankshaft obtained from the output signal (pulse signal) of the crank angle sensor 62. Also, based on operating condition information from various kinds of unillustrated sensors in addition to the number of revolutions per minute of the engine NE obtained from the output signal of the crank angle sensor 62 and the amount of depression AP of the accelerator pedal 63 detected by the accelerator position sensor 64, the fuel injection amount calculation section 70 calculates the fuel injection amounts Qi to be injected from the fuel injection valves 51 through 54 for the respective cylinders to be controlled.

The fuel injection valve control section 71 determines the injection pulse widths to drive the fuel injection valves 51 through 54, respectively, based on the fuel injection amount Qi per cylinder calculated by the fuel injection amount calculation section 70, and sets drive timings for the fuel injection valves 51 through 54, respectively. As a result, the fuel injection valves 51 through 54 are driven by the drive timings set by the fuel injection valve control section 71.

The FF amount calculation section 72 multiplies the fuel injection amount Qi by M/N (=4/3) based on the fuel injection amount Qi calculated by the fuel injection amount calculation section 70, and calculates the fuel injection amount Qi thus multiplied by 4/3 (i.e., 4Qi/3) only in N times (=3 times) as an FF amount (feedforward amount) in the fuel discharge amount of the high pressure fuel pump 20 during the time when the fuel injection stroke makes a round of the respective cylinders. Specifically, the FF amount is calculated at every second calculation timing based on an average value of fuel injection amounts, as will be described later.

The FB amount calculation section 73 calculates the target fuel pressure PO in the fuel rail 50 based on the operating condition information from the various kinds of sensors in addition to the number of revolutions per minute of the engine NE obtained from the output signal of the crank angle sensor 62 and the amount of depression AP of the accelerator pedal 63 obtained from the accelerator position sensor 64. Moreover, the FB amount calculation section 73 calculates the FB amount in the fuel discharge amount of the high pressure fuel pump 20 based on the pressure deviation between the target fuel pressure PO thus calculated and the actual fuel pressure PF detected by the fuel pressure sensor 61.

The fuel discharge amount control section 74 calculates the amount of fuel QP to be discharged from the high pressure fuel pump 20 to the fuel rail 50 by adding the FF amount calculated by the FF amount calculation section 72 and the FB amount calculated by the FB amount calculation section 73, and sets drive timing for the fuel discharge amount control valve 10. As a result, the fuel discharge amount control valve 10 is driven by the drive timing set by the fuel discharge amount control section 74.

In addition, the high pressure fuel pump 20 has N fuel discharge strokes with respect to the fuel rail 50 during the time when the fuel injection stroke makes a round of the respective cylinders, as stated above. Here, note that N is a natural number that is not less than 2 and is smaller than the number of cylinders M (>3) (i.e., N<M), with the value of M/N being not a natural number. In this example, N is 3 for the number of cylinders M=4.

Now, reference will be made to the control operation of the fuel pressure control apparatus for a multicylinder internal combustion engine according to the first embodiment of the present invention while referring to a flow chart of FIG. 8. Here, note that the control routine of FIG. 8 is executed at the predetermined three second execution timings, i.e., upon occurrence of second calculation timings Tp1, Tp2 and Tp3, respectively, in FIG. 5.

Figure 8:
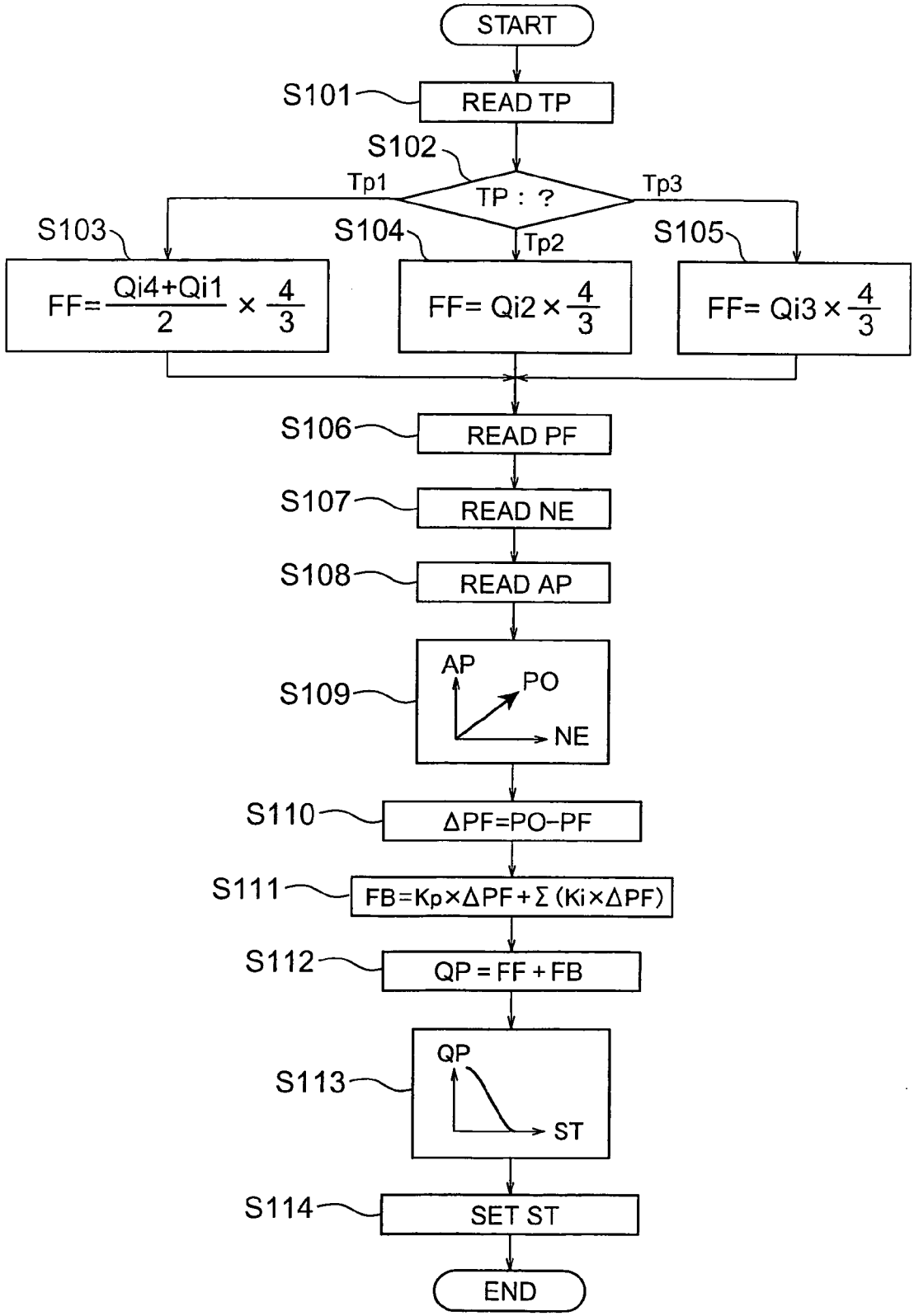
FIG. 8 is a flow chart illustrating the control operation of the fuel pressure control apparatus for a multicylinder internal combustion engine seventh embodiment of the present invention.

In FIG. 8, first of all, an identification number TP to identify the current execution timing is read (step S101). Note that the identification number TP corresponds to either one of the second calculation timings Tp1, Tp2 and Tp3 (see FIG. 5). Subsequently, it is determined from the thus read identification number TP whether the current execution timing is either one of the second calculation timings Tp1, Tp2 and Tp3 (step S102), and respective processes are carried out in accordance with the different results of the determination.

That is, if it is determined in step S102 that the identification number TP is Tp1 (TP=Tp1), an average value of the fuel injection amounts Qi4, Qi1 (see FIG. 5) calculated for a duration from the last execution timing Tp3 to the current execution timing Tp1 is multiplied by 4/3 to provide 4/3 times the average value as an FF amount (step S103), and the control flow then proceeds to the following step S106. The FF amount at this time is represented by the following expression (1).

$$FF=(Qi4+Qi1)/2\times(4/3) \quad (1)$$

In addition, if it is determined in step S102 that the identification number TP is Tp2 (TP=Tp2), the fuel injection amount Qi2 (see FIG. 5) calculated for a duration from the last execution timing Tp1 to the current execution timing Tp2 is multiplied by 4/3 to provide 4/3 times Qi2 as an FF amount (step S104), and the control flow then proceeds to step S106. The FF amount at this time is represented by the following expression (2).

$$FF=Qi2\times(4/3) \quad (2)$$

Moreover, if it is determined in step S102 that the identification number TP is Tp3 (TP=Tp3), the fuel injection amount Qi3 (see FIG. 5) calculated for a duration from the last execution timing Tp2 to the current execution timing Tp3 is multiplied by 4/3 to provide 4/3 times Qi3 as an FF amount (step S105), and the control flow then proceeds to step S106. The FF amount at this time is represented by the following expression (3).

$$FF=Qi3\times(4/3) \quad (3)$$

The processes of the above steps S101 through S105 correspond to the operation of the FF amount calculation section 72 (see FIG. 7) in the ECU 60. Then, the fuel pressure PF detected by the fuel pressure sensor 61 is read (step S106), and the number of revolutions per minute of the engine NE obtained from the output signal of the crank angle sensor 62 is read (step S107), and the amount of depression AP of the accelerator pedal 63 detected by the accelerator position sensor 64 is read (step S108).

Subsequently, the target fuel pressure PO is set based on a linear function map data from the number of revolutions per minute of the engine NE read in step S107 and the amount of depression AP of the accelerator pedal 63 read in step S108 (step S109). In addition, a pressure deviation Δ PF between the target fuel pressure PO set in step S109 and the fuel pressure PF read in step S106 is calculated, as shown in the following expression (4) (step S110).

$$\Delta PF=PO-PF \quad (4)$$

Subsequently, the FB amount is calculated according to a proportional integral calculation based on the pressure deviation Δ PF calculated in step S110, as shown in the following expression (5).

$$FB=Kp\times\Delta PF+\Sigma(Ki\times\Delta PF) \quad (5)$$

where Kp represents a proportional gain in the proportional integral calculation in expression (5), and Ki represents an integral gain.

The processes of the above steps S106 through S111 correspond to the operation of the FB amount calculation section 73 (see FIG. 7) in the ECU 60.

Then, the fuel discharge amount QP of the high pressure fuel pump 20 is determined by adding the FF amount calculated at the current execution timing (in either of steps S103 through S105) and the FB amount calculated in step S111, as shown in the following expression (6) (step S112).

$$QP=FF+FB \quad (6)$$

Subsequently, the energization start timing ST of the solenoid 14 in the fuel discharge amount control valve 10 is determined by using characteristic data between the energization start timing ST stored beforehand in the ECU 60 and the fuel discharge amount QP (see FIG. 4) in accordance with the fuel discharge amount QP determined in step S112 (step S113). Finally, the energization start timing ST of the solenoid 14 determined in step S113 is set (step S114), and the control flow exits the processing routine of FIG. 8. The processes of the above steps S113 and S114 correspond to the operation of the fuel discharge amount control section 74 (see FIG. 7) in the ECU 60.

Hereinafter, by energizing the solenoid 14 at a predetermined energization start timing ST (set in step S113) in the fuel discharge stroke, fuel is discharged from the high pressure fuel pump 20 to be supplied to the fuel rail 50. Here, assuming that a total of fuel amounts injected during the time when the fuel injection stroke makes a round of the respective cylinders is represented by Qisum, the total fuel injection amount Qisum is represented according to the following expression (7).

$$Qi\text{sum}=Qi1+Qi2+Qi3+Qi4 \quad (7)$$

Accordingly, assuming that the four-cylinder internal combustion engine 40 operates in the steady state and that substantially the same fuel injection amount Qi is injected into each of the cylinders, expression (7) above can be represented by the following expression (8).

$$\text{Qisum}=4\text{Qi} \quad (8)$$

On the other hand, assuming that a total of FF amounts during the time when the fuel injection stroke makes a round of the respective cylinders is represented by FFsum, the total value FFsum of the FF amounts calculated at execution timings (second calculation timings) Tp1, Tp2 and Tp3 is represented, as shown in the following expression (9).

$$FF\text{sum}=(Qi1+Qi4)/2\times(4/3)+Qi2\times(4/3)+Qi3\times(4/3) \quad (9)$$

Accordingly, assuming that the four-cylinder internal combustion engine 40 operates in the steady state and that substantially the same fuel injection amount Qi is injected into each of the cylinders, expression (9) above can be represented by the following expression (10).

$$FF\text{sum}=(Qi+Qi)/2\times(4/3)+Qi\times(4/3)+Qi\times(4/3)=4Qi \quad (10)$$

As a result, the fuel balance of the fuel rail 50 becomes zero, as clear from expressions (8) and (10), so the fuel pressure PF in the fuel rail 50 is maintained at the present value.

In other words, in spite of the fact that the general high pressure fuel pump 20 of three cam crests (=3) is adopted, the maximum fuel discharge amount QPmax required for one discharge stroke can be reduced to ⅔times the maximum fuel injection amount per cylinder Qimax. In other words, the amount twice as large as the maximum fuel injection amount Qimax made required by prior art general control (see FIG. 5) will not be needed.

Although the FF amount at the time of the identification number TP=Tp1 is calculated according to the above-mentioned expression (1) in step S103 in FIG. 8, it may be calculated as shown by the following expression (11) while assuming Qi4=Qi1 so as to simplify software processing.

$$FF=Qi1\times(4/3) \quad (11)$$

Even if a calculation method of thinning out the fuel injection amount Qi4 to the cylinder #4 is simply adopted, as shown in expression (11) above, it is possible to obtain substantially the same fuel balance as referred to above.

As described above, the fuel injection control apparatus for an internal combustion engine according to the first embodiment of the present invention includes the fuel injection valves 51 through 54 that are arranged one for each cylinder for injecting fuel into the internal combustion engine 40 with M cylinders (M≧3), the fuel injection amount calculation section 70 that calculates the fuel injection amount Qi per cylinder to be injected into each of the cylinders, the fuel injection valve control section 71 that determines the injection pulse width of each of the fuel injection valves 51 through 54 based on the fuel injection amount Qi thereby to set the drive timing for each of the fuel injection valves 51 through 54, the fuel rail 50 that is connected in common with the fuel injection valves 51 through 54 to store high pressure fuel, the fuel pressure sensor 61 that detects the fuel pressure PF in the fuel rail 50, the high pressure fuel pump 20 that has three fuel discharge strokes with respect to the fuel rail 50 during the time when the fuel injection stroke makes a round of the respective cylinders, the fuel discharge amount control valve 10 that adjusts the fuel discharge amount QP of the high pressure fuel pump 20, the FF amount calculation section 72 that calculates the feedforward (FF) amount in the fuel discharge amount QP of the high pressure fuel pump 20 based on the fuel injection amount Qi, the FB amount calculation section 73 that calculates the feedback (FB) amount in the fuel discharge amount of the high pressure fuel pump 20 based on the pressure deviation between the target fuel pressure PO set in accordance with the operating condition of the internal combustion engine 40 and the actual fuel pressure PF detected by the fuel pressure sensor 61, and the fuel discharge amount control section 74 that determines the fuel discharge amount QP of the high pressure fuel pump 20 by adding the FF amount and the FB amount to each other, and sets the drive timing of the fuel discharge amount control valve 10.

The fuel injection amount calculation section 70, the fuel injection valve control section 71, the FF amount calculation section 72, the FB amount calculation section 73, and the fuel discharge amount control section 74 are constituted by the ECU 60 including a microcomputer. In addition, the FF amount calculation section 72 uses the fuel injection amount Qi multiplied by ⅔ as the FF amount in the fuel discharge amount QP of the high pressure fuel pump 20 in three times while the fuel injection stroke to the respective cylinders of the four-cylinder internal combustion engine 40 goes a round.

As a result, the maximum fuel discharge amount QPmax can be decreased up to about (4/3)/2 (=2/3) times while adopting the high pressure fuel pump 20 with the number of cam crests=3 for the four-cylinder internal combustion engine 40 for example. Accordingly, the stress on the contact surfaces between the plunger 22 and the cam 25 at the time of the maximum fuel injection amount Qimax is reduced to improve their durability, and at the same time, the volume of the pressure chamber 23 of the high pressure fuel pump 20 can be miniaturized up to about 2/3 of the conventional one. Moreover, if the maximum fuel discharge amount QPmax is set to the same amount as in the past while adopting the high pressure fuel pump 20 with three cam crests for instance, the present invention can be applied in particular to a high power internal combustion engine with a large maximum fuel injection amount Qimax without deteriorating the durability thereof.

Although reference has herein been made to the case where the high pressure fuel pump 20 having three fuel discharge strokes (i.e., the number of cam crests N=3) is used for the four-cylinder internal combustion engine 40 (i.e., the number M of cylinders=4), the present invention is not limited to this but can be applied to any engine having any number of cylinders M and any number of cam crests N even if the number of cylinders M and the number of cam crests satisfy the following relation; $M \geqq 3$, $N \geqq 2$, $M>N$, and M/N is not equal to a natural number. For instance, a high pressure fuel pump having two fuel discharge strokes (i.e., the number of cam crests N=2) may be used for an internal combustion engine with three cylinders (i.e., the number of cylinders=3), or a high pressure fuel pump having three or four fuel discharge strokes (N=3 or 4) may be used for an internal combustion engine with five cylinders (M=5), or a high pressure fuel pump having four or five fuel discharge strokes (N=4 or 5) may be used for an internal combustion engine with six cylinders (M=6). It is needless to say that operational effects equivalent to those as stated above can be obtained in any of these cases, too.

In addition, though no reference has been made to a specific control range of the fuel discharge amount QP, the fuel discharge amount control section 74 may set the maximum fuel discharge amount QPmax that can be discharged in one fuel discharge stroke in the high pressure fuel pump 20 to a range from 4/3 times (inclusive) to less than 2 times the maximum fuel injection amount per cylinder. With such a setting, even if various conditions such as the surrounding environment of the internal combustion engine 40 or the like are taken into consideration, it is possible to achieve the above-mentioned operational effects in a reliable manner.

Further, provision is made for the fuel pressure sensor 61 that detects the actual fuel pressure PF in the fuel rail 50, and the FB amount calculation section 73 that calculates the feedback amount in the fuel discharge amount of the high pressure fuel pump 20 as the FB amount. The FB amount calculation section 73 serves to set the target fuel pressure PO in accordance with the operating condition of the internal combustion engine 40, and calculate the FB amount based on the pressure deviation of the fuel pressure PF from the target fuel pressure PO. The fuel discharge amount control section 74 determines the fuel discharge amount of the high pressure fuel pump 20 by adding the FF amount and the FB amount to each other, so that fuel pressure control errors resulting from accuracy variation and/or degradation of component parts of the fuel feed system can be thereby compensated. That is, when a pressure deviation is generated between the fuel pressure PF detected and the target fuel pressure PO in spite of the FF amount being fed to the fuel rail 50, the fuel pressure can be corrected by the FF amount that is calculated by the proportional-plus-integral control or the like.

Embodiment 2

Though not specifically referred to in the above-mentioned first embodiment, in an internal combustion engine having a rotational phase adjustment section for adjusting the rotational phase of the camshaft 24 relative to the crankshaft, it is desirable to preset the positional relation of the first and second calculation timings so as not to change the order of occurrence of the first and second calculation timings when the rotational phase of the camshaft 24 relative to the rotational phase of the crankshaft is adjusted to the most retarded angle side or to the most advanced angle side.

Hereinafter, reference will be made to a second embodiment of the present invention that is applied to an internal combustion engine having a rotational phase adjustment section. The overall construction of a fuel pressure control apparatus for a multicylinder internal combustion engine according to the second embodiment of the present invention is the same as the one shown in FIG. 1 except for a difference in a part of the functional configuration of ECUs 60 (see FIG. 1 and FIG. 7). In this case, the ECU 60 of FIG. 7 is provided with a rotational phase adjustment section (not shown) which serves to adjust the rotational phase of the camshaft 24 relative to the rotational phase of the crankshaft based on the rotational phase of the crankshaft detected by the crank angle sensor 62 and the rotational phase of the camshaft 24 detected by the cam angle sensor 65.

In addition, the ECU 60 is provided with a first calculation timing generation section and a second calculation timing generation section. The first calculation timing generation section generates first calculation timings to execute or actuate at least a fuel injection amount calculation section at first angular positions that are synchronized with the rotational phase of the crankshaft, and the second calculation timing generation section generates second calculation timings to execute or actuate at least an FF amount calculation section at second angular positions that are synchronized with the rotational phase of the camshaft 24. Further, the positional relation of the order of occurrence of the first and second calculation timings is preset in such a manner that each second calculation timing is generated immediately after a corresponding first calculation timing when the rotational phase of the camshaft 24 relative to the rotational phase of the crankshaft is adjusted to the most retarded angle side or to the most advanced angle side by the rotational phase adjustment section.

Figure 9A:
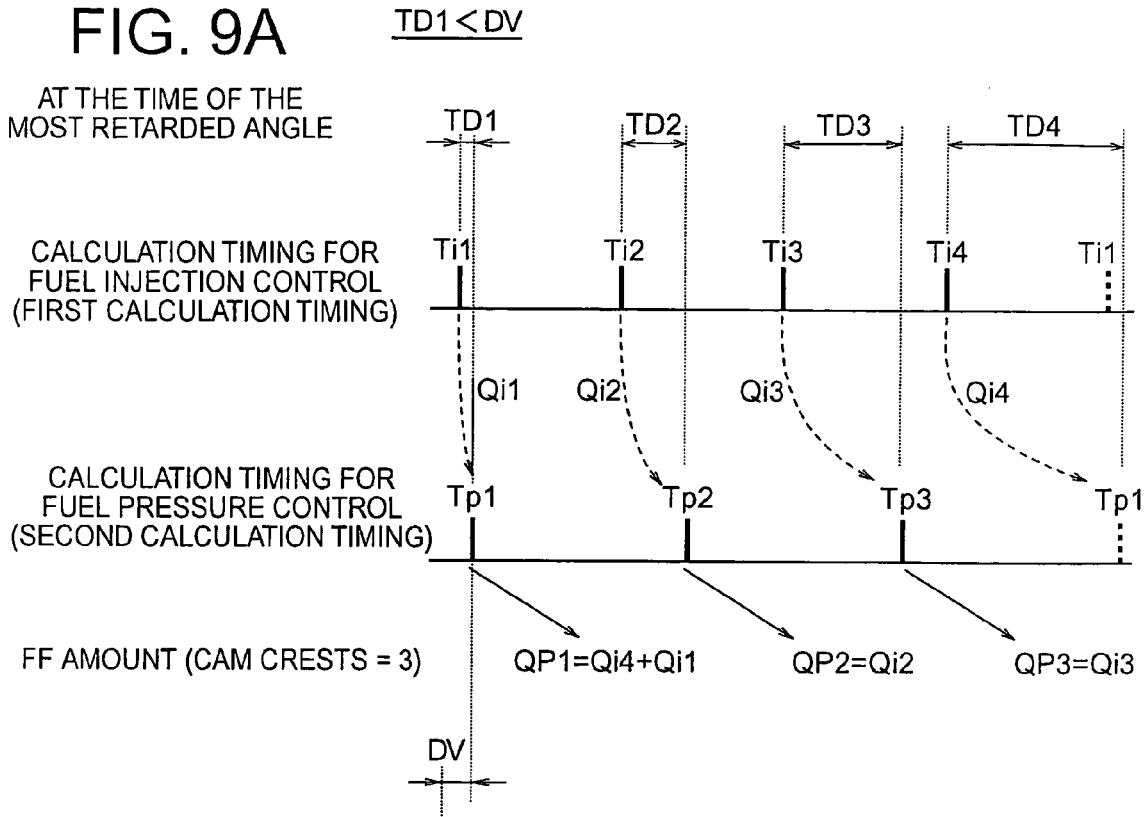
FIGS. 9A and 9B are timing charts illustrating the control operation of a fuel pressure control apparatus for a multicylinder internal combustion engine according to a second embodiment of the present invention.
Figure 9B:
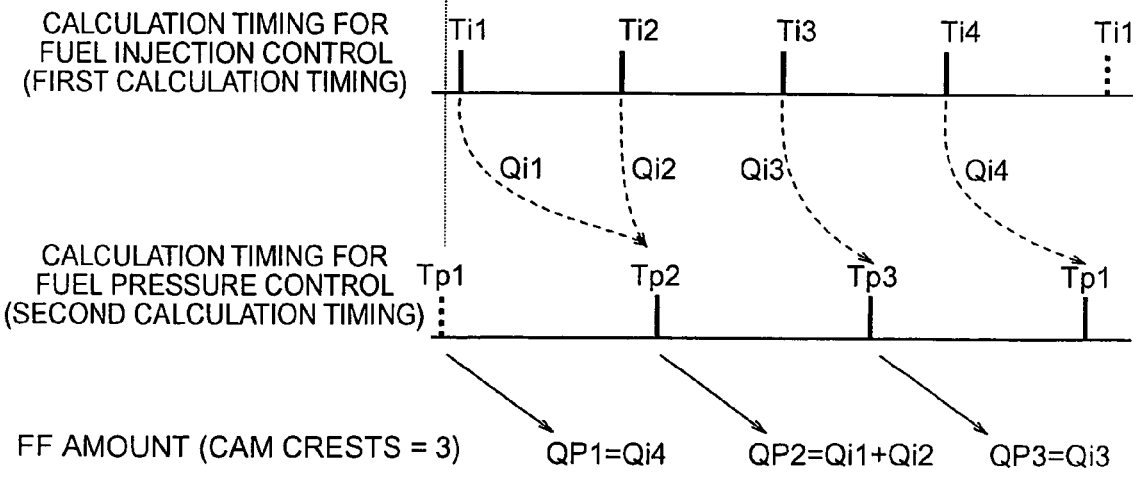

First of all, reference will be made to the basic control operation of the internal combustion engine 40 with the rotational phase adjustment section for adjusting the rotation phase of the camshaft 24 relative to the rotational phase of the crankshaft, with reference to timing charts of FIGS. 9A and 9B, while taking an example of the case where the second embodiment of the present invention is not applied. FIG. 9A illustrates the positional relation of the first and second calculation timings Ti and Tp when the rotational phase of the camshaft 24 relative to the rotational phase of the crankshaft is in the "most retarded angle side". FIG. 9B illustrates the positional relation of the first and second calculation timings Ti and Tp when the rotational phase of the camshaft 24 relative to the rotational phase of the crankshaft is in the "most advanced angle side".

In FIGS. 9A and 9B, the relation between the positional relation of the first and second calculation timings Ti and Tp and the actually calculated FF amount when the number of cam crests for the high pressure fuel pump 20 is set to 3 for the internal combustion engine 40 of the adjustable phase type with the rotational position adjustment section is schematically illustrated for comparison between the operation at the time of the most retarded angle (FIG. 9A) and the operation at the time of the most advanced angle (FIG. 9B).

Also, angular intervals TD between the corresponding first and second calculation timings Ti and Tp are indicated as angular intervals TD1, TD2, TD3 and TD4 at respective timings. Further, with respect to the second calibration timings Tp, a difference between the most retarded angle (FIG. 9A) and the most advanced angle (FIG. 9B) is taken to show a maximum angle width DV that can be adjusted by the rotational phase adjustment section.

In FIGS. 9A and 9B, four first calculation timings Ti1, Ti2, Ti3 and Ti4 are provided during the time when the fuel injection stroke makes a round of the respective cylinders, similarly as described above, and fuel injection amounts Qi1, Qi2, Qi3 and Qi4 are calculated respectively at individual timings, so that the drive timings for the respective fuel injection valves 51 through 54 are set respectively at predetermined timings.

In addition, three second calculation timings Tp1, Tp2 and Tp3 are provided during the time when the fuel injection stroke makes a round of the respective cylinders, and FF amounts QP1, QP2 and QP3 for the fuel discharge amount are calculated respectively at individual timings, so that drive timings for the fuel discharge amount control valve 10 are set at respective predetermined timings.

When attention is focused on the positional relation between the respective first calculation timings Ti and the following second calculation timings Tp generated immediately thereafter at the retard angle side at the time of the most retarded angle (FIG. 9A), it is found that an angular interval TD1 between the first one Ti1 of the first calculation timings and the following second calculation timing Tp1 generated immediately thereafter is in the narrowest positional relation, and after that, an angular interval TD2 between Ti2 and Tp2, an angular interval TD3 between Ti3 and Tp3, and an angular interval TD4 between Ti4 and Tp1 are in the positional relation in which they are wider than the angular interval TD1.

Here, note that in the case of the positional relation of FIG. 9A, the FF amounts of the fuel discharge amounts calculated at the respective second calculation timings Tp are as follows. That is, an FF amount QP1 calculated at the first second calculation timing Tp1 is represented by the following expression (12).

$$QP1=Qi4+Qi1 \tag{12}$$

Also, FF amounts QP2 and QP3 calculated subsequently at the second and third calculation timings Tp2 and Tp2 are represented by the following expressions (13) and (14), respectively.

$$QP2=Qi2 \tag{13}$$

$$QP3=Qi3 \tag{14}$$

On the other hand, the positional relation of the first and second calculation timings Ti and Tp at the most advanced angle side (FIG. 9B) is such that the rotational phase adjustment section is operated to move the rotational phase of the camshaft 24 to the advance angle side by the maximum angle width DV (TD1<DV) that is adjustable with respect to the rotational phase of the crankshaft. Here, when attention is focused on the positional relation between the first ones Ti1 and Tp1 of the first and second calculation timings, being in the narrowest positional relation (the angular interval TD1 being a minimum) at the most retarded angle side (FIG. 9A), it is found that the order of occurrence of the first calculation timing Ti1 and the second calculation timing Tp1 is changed or replaced with each other.

As a result, in the case of the positional relation at the most advanced angle side (FIG. 9B), the FF amounts QP1, QP2 and QP3 for the fuel discharge amounts calculated at the second calculation timings Tp1, Tp2 and Tp3, respectively, are represented by the following expressions (15), (16) and (17), respectively.

$$QP1=Qi4 \tag{15}$$

$$QP2=Qi1+Qi2 \tag{16}$$

$$QP3=Qi3 \tag{17}$$

Thus, if the angular interval TD between a first calculation timing Ti and a second calculation timing Tp is set to the angular interval TD1 that is narrower than the maximum angle width DV that can be adjusted by the rotational phase adjustment section upon adjustment of the rotational phase of the camshaft 24 relative to the rotational phase of the crankshaft to the "most retarded angle side" by means of the rotational phase adjustment section, there will be two cases, i.e., the fuel injection amount Qi1 used for the FF amount QP1 is calculated, in one case, at the first second calculation timing Tp1, and in the other case, at the following one Tp2 of the second calculation timings, and hence there is a possibility that the stable FF amount QP can not be calculated.

Accordingly, in order to solve such a problem, the ECU 60 according to the second embodiment of the present invention is provided with the first calculation timing generation section and the second calculation timing generation section, and the positional relation of the first and second calculation timings Ti, Tp is set beforehand so as not to change the order of occurrence of the first and second calculation timings Ti, Tp at the times of the most retarded angle and the most advanced angle.

Hereinafter, reference will be made to the fuel pressure control operation of the second embodiment of the present invention while referring to FIG. 10. FIGS. 10A and 10B are timing charts that each illustrate the relation between the positional relation of the first and second calculation timings Ti and Tp and the actually calculated FF amount QP, wherein suitable control operation is shown when the number of cam crests for the high pressure fuel pump 20 is set to 3 for the internal combustion engine 40 in which the rotational phase of the camshaft 24 relative to the rotational phase of the crankshaft can be adjusted by the rotational phase adjustment section.

Figure 10A:
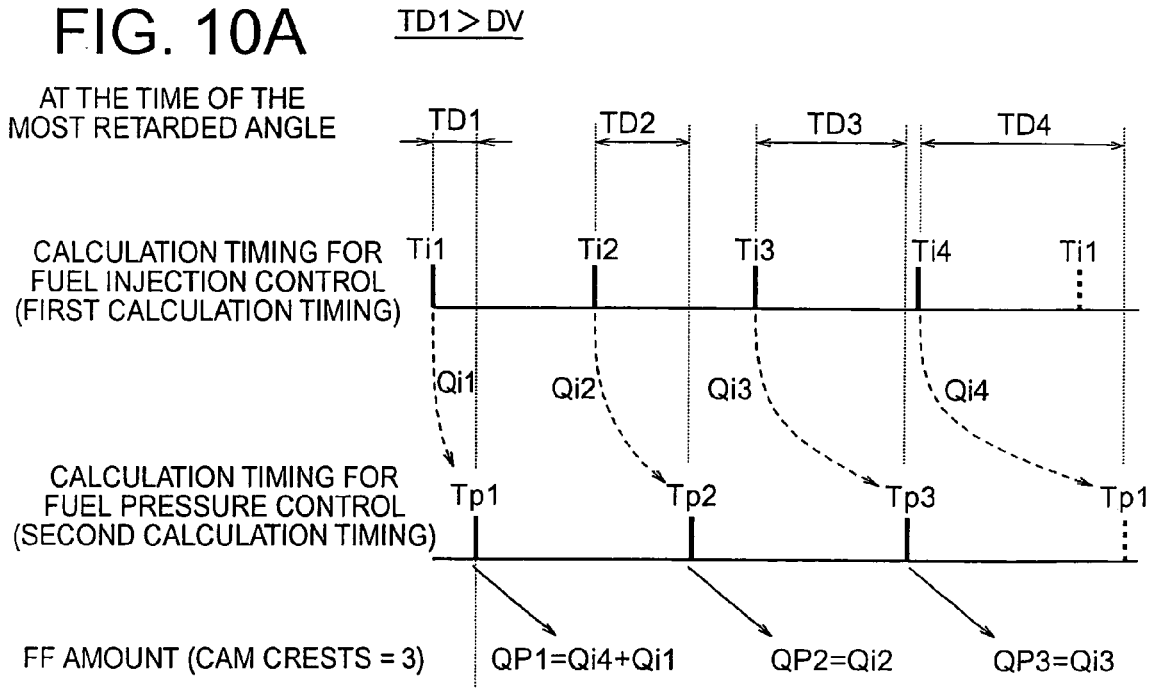
FIGS. 10A and 10B are timing charts illustrating the control operation of the fuel pressure control apparatus for a multicylinder internal combustion engine according to the second embodiment of the present invention.

FIG. 10A illustrates the case in which the first and second calculation timings Ti and Tp are set to be a suitable positional relation when the rotational phase of the camshaft 24 relative to the rotational phase of the crankshaft is in the "most retarded angle side". Focusing attention to the angular interval TD1 between the first ones Ti1, Tp1 of the first and second calculation timings Ti, Tp in which the angular interval TD between the first and second calculation timings Ti, Tp becomes a minimum (i.e., in the narrowest positional relation) in FIG. 10A, the first and second calculation timings Ti, Tp are set in such a manner that their relation to the adjustable maximum angle width DV of the rotational phase adjustment section becomes "TD1>DV".

Figure 10B:
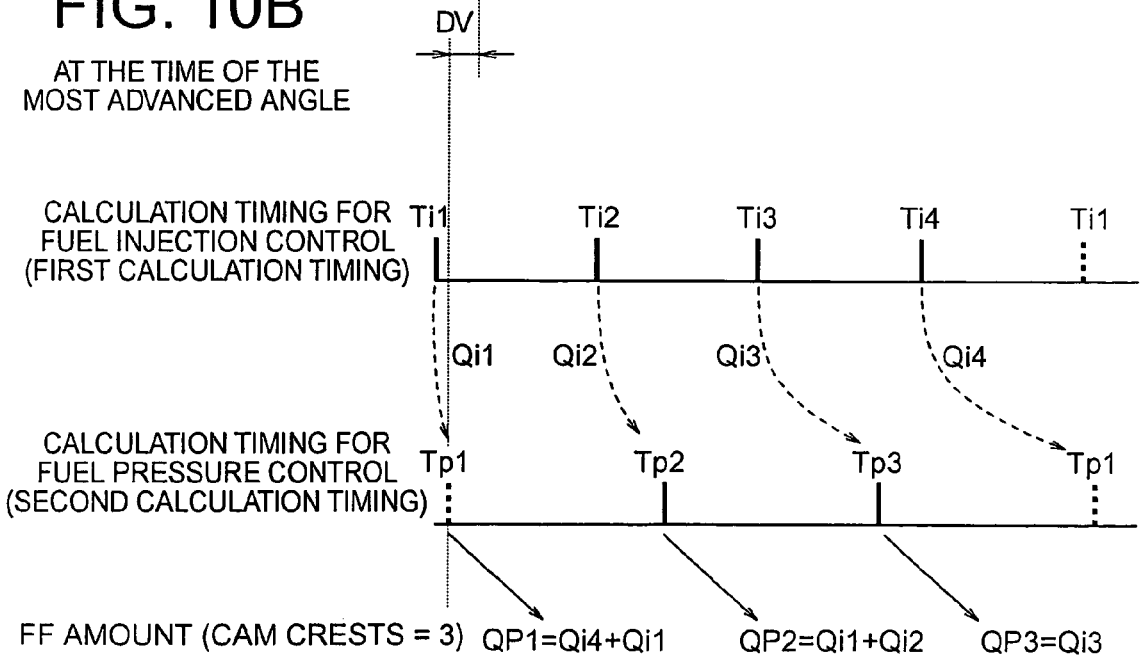

As a result, even when the rotational phase of the camshaft 24 relative to the rotational phase of the crankshaft is in the "most retarded angle side", as shown in FIG. 10A, or even when the rotational phase of the camshaft 24 relative to the rotational phase of the crankshaft is in the "most advanced angle side", as shown in FIG. 10B, the FF amounts QP1, QP2 and QP3 for the fuel discharge amounts calculated at the second calculation timings Tp1, Tp2 and Tp3, respectively, are represented by the above-mentioned expressions (12), (13) and (14), respectively. That is, the positional relation is preset in such a manner that the order of occurrence of the first and second calculation timings Ti and Tp is not changed or replaced regardless of the operating condition of the rotational phase adjustment section, so it is possible to calculate the FF amount QP at all times in a stable manner.

As described above, the fuel injection control apparatus for an internal combustion engine according to the second embodiment of the present invention includes the crank angle sensor 62 that detects the rotational phase of the crankshaft of the internal combustion engine 40, the cam angle sensor 65 that detects the rotational phase of the camshaft 24 of the internal combustion engine 40, the rotational phase adjustment section that adjusts the rotational phase of the camshaft 24 relative to the rotational phase of the crankshaft, the first calculation timing generation section that generates first calculation timings Ti to execute or actuate at least the fuel injection amount calculation section at first angular positions that are synchronized with the rotational phase of the crankshaft, and the second calculation timing generation section that generates second calculation timings Tp to execute or actuate at least the FF amount calculation section at second angular positions that are synchronized with the rotational phase of the camshaft 24.

The rotational phase adjustment section and the first and second calculation timing generation sections are constituted by the ECU 60. The first calculation timings Ti are calculated and set as timings for executing or actuating the fuel injection amount calculation section 70 and the fuel injection valve control setting section 71. Also, the second calculation timings Tp calculated and set as timings for executing or actuating the FF amount calculation section 72, the FB amount calculation section 73, and the fuel discharge amount control section 74. Further, as stated above, the positional relation of the order of occurrence of the first and second calculation timings Ti, Tp is preset in such a manner that the second calculation timings are generated immediately after the corresponding first calculation timings when the rotational phase of the camshaft 24 relative to the rotational phase of the crankshaft is adjusted to the most retarded angle side or to the most advanced angle side by the rotational phase adjustment section.

Thus, in the internal combustion engine 40 having the rotational phase adjustment section, in case of the high pressure fuel pump 20 with the number of cam crests=N (e.g., N=3) being adopted, the first and second calculation timings Ti and Tp are set to be in such a positional relation that the order of occurrence of the first calculation timings Ti and the second calculation timings Tp is not changed regardless of the operating condition of the rotational phase adjustment section (i.e., at the most retarded angle or at the most advanced angle). As a result, the predetermined fuel injection amounts Qi can always be used as the FF amounts QP at predetermined second calculation timings Tp regardless of the operating condition of the rotational phase adjustment section. Accordingly, it is possible to avoid the repeated use of the same fuel injection amount Qi or the missing use of a certain fuel injection amount Qi, so it is possible to suppress variation in the calculation of the FF amounts QP, thereby making it is possible to improve the reliability of fuel pressure control.

While the invention has been described in terms of preferred embodiments, those skilled in the art will recognize that the invention can be practiced with modifications within the spirit and scope of the appended claims.

What is claimed is:

1. A fuel pressure control apparatus for a multicylinder internal combustion engine in which fuel is injected into the internal combustion engine having M cylinders, said apparatus comprising:

fuel injection valves arranged one for each of said cylinders;

a fuel injection amount calculation section that calculates a fuel injection amount per cylinder to be injected into each of said cylinders;

a fuel injection valve control section that determines the injection pulse width of each of said fuel injection valves based on said fuel injection amount thereby to set the drive timing for each of said fuel injection valves;

a fuel rail that is connected in common with said fuel injection valves to store high pressure fuel;

a high pressure fuel pump that has N fuel discharge strokes with respect to said fuel rail while a fuel injection stroke makes a round of said respective cylinders;

a fuel discharge amount control valve that adjusts a fuel discharge amount from said high pressure fuel pump;

an FF amount calculation section that calculates, as an FF amount, a feedforward amount in the fuel discharge amount of said high pressure fuel pump based on said fuel injection amount; and a fuel discharge amount control section that determines the fuel discharge amount of said high pressure fuel pump based on said FF amount and sets the drive timing of said fuel discharge amount control valve;

wherein said FF amount calculation section uses said fuel injection amount multiplied by M/N as an FF amount in the fuel discharge amount of said high pressure fuel pump in three times while the fuel injection stroke makes a round of said respective cylinders.

2. The fuel pressure control apparatus for a multicylinder internal combustion engine as set forth in claim 1, wherein said fuel discharge amount control section sets a maximum fuel discharge amount that can be discharged in one fuel discharge stroke of said high pressure fuel pump to a range from M/N times to less than 2 times a maximum fuel injection amount per cylinder.

3. The fuel pressure control apparatus for a multicylinder internal combustion engine as set forth in claim 1, further comprising:

a fuel pressure sensor that detects a fuel pressure in said fuel rail; and an FB amount calculation section that sets a target fuel pressure in accordance with the operating condition of said internal combustion engine, and calculates the feedback amount in the fuel discharge amount of said high pressure fuel pump as an FB amount based on a pressure deviation between said fuel pressure and said target fuel pressure; and wherein said fuel discharge amount control section adds said FF amount and said FB amount to each other to determine the fuel discharge amount of said high pressure fuel pump.

4. The image input apparatus as set forth in claim 1, further comprising:

a crank angle sensor that detects the rotational phase of a crankshaft of said internal combustion engine;

a cam angle sensor that detects the rotational phase of a camshaft of said internal combustion engine;

a rotational phase adjustment section that adjusts the rotational phase of said camshaft relative to the rotational phase of said crankshaft;

a first calculation timing generation section that generates first calculation timings to actuate at least said fuel injection amount calculation section at first angular positions that are synchronized with the rotational phase of said crankshaft; and a second calculation timing generation section that generates a second calculation timing to actuate at least said FF amount calculation section at second angular positions that are synchronized with the rotational phase of said camshaft;

wherein when the rotational phase of said camshaft relative to the rotational phase of said crankshaft is adjusted to the most retarded angle side or to the most advanced angle side by said rotational phase adjustment section, the positional relation of the order of occurrence of said first and second calculation timings is set beforehand in such a manner that said second calculation timings are generated immediately after said corresponding first calculation timings, respectively.

* * * * *